US006592429B1

(12) United States Patent
Campbell

(10) Patent No.: US 6,592,429 B1
(45) Date of Patent: Jul. 15, 2003

(54) METHOD AND APPARATUS FOR CONTROLLING WAFER UNIFORMITY IN A CHEMICAL MECHANICAL POLISHING TOOL USING CARRIER HEAD SIGNATURES

(75) Inventor: William J. Campbell, Austin, TX (US)

(73) Assignee: Advanced Micro Devices, Inc., Austin, TX (US)

( * ) Notice: Subject to any disclaimer, the term of this patent is extended or adjusted under 35 U.S.C. 154(b) by 49 days.

(21) Appl. No.: 09/627,737

(22) Filed: Jul. 28, 2000

(51) Int. Cl.[7] ..... B24B 49/00; B24B 51/00; B24B 1/00

(52) U.S. Cl. ..... 451/8; 451/41; 451/63; 451/288

(58) Field of Search ..... 451/8, 41, 63, 451/285, 286, 287, 288, 289, 290, 398

(56) References Cited

U.S. PATENT DOCUMENTS

| | | | | |
|---|---|---|---|---|
| 5,609,719 A | | 3/1997 | Hempel | 156/636.1 |
| 6,241,585 B1 | * | 6/2001 | White | 451/285 |
| 6,244,932 B1 | * | 6/2001 | Govzman et al. | 451/288 |
| 6,244,935 B1 | * | 6/2001 | Birang et al. | 451/288 |

FOREIGN PATENT DOCUMENTS

| | | | |
|---|---|---|---|
| EP | 0727807 A1 | 8/1996 | H01J/37/32 |
| EP | 0827193 A2 | 3/1998 | H01L/21/66 |
| EP | 0951963 A2 | 10/1999 | B24B/37/04 |

OTHER PUBLICATIONS

International Search Report dated Feb. 8, 2002 for International application No. PCT/US01/21142 Filed Jul. 3, 2001.

* cited by examiner

*Primary Examiner*—Timothy V. Eley
(74) *Attorney, Agent, or Firm*—Williams, Morgan & Amerson, P.C.

(57) ABSTRACT

A method for controlling wafer uniformity in a polishing tool includes providing a plurality of carrier heads, determining a signature for each of the carrier heads, and installing carrier heads with similar signatures in a polishing tool. A processing line includes a polishing tool and a processing tool. The polishing tool is adapted to polish wafers. The polishing tool includes a plurality of carrier heads, each carrier head having a polishing signature similar to the other carrier heads. The processing tool is adapted to process the polished wafers in accordance with a recipe. At least one parameter in the recipe is based on the polishing signatures of the carrier heads.

22 Claims, 3 Drawing Sheets

METHOD AND APPARATUS FOR CONTROLLING WAFER UNIFORMITY IN A CHEMICAL MECHANICAL POLISHING TOOL USING CARRIER HEAD SIGNATURES

BACKGROUND OF THE INVENTION

1. Field of the Invention

This invention relates generally to semiconductor device manufacturing, and, more particularly, to a method and apparatus for controlling wafer uniformity in a chemical mechanical polishing tool using carrier head signatures.

2. Description of the Related Art

Chemical mechanical polishing (CMP) is a widely used means of planarizing silicon dioxide as well as other types of layers on semiconductor wafers. Chemical mechanical polishing typically utilizes an abrasive slurry disbursed in an alkaline or acidic solution to planarize the surface of the wafer through a combination of mechanical and chemical action. Generally, a chemical mechanical polishing tool includes a polishing device positioned above a rotatable circular platen or table on which a polishing pad is mounted. The polishing device may include one or more rotating carrier heads to which wafers may be secured, typically through the use of vacuum pressure. In use, the platen may be rotated and an abrasive slurry may be disbursed onto the polishing pad. Once the slurry has been applied to the polishing pad, a downward force may be applied to each rotating carrier head to press the attached wafer against the polishing pad. As the wafer is pressed against the polishing pad, the surface of the wafer is mechanically and chemically polished.

Generally, within-wafer uniformity variations (i.e., surface non-uniformity) are produced by slight differences in polish rate at various positions on the wafer. FIG. 1 illustrates two radial profiles of surface non-uniformity typically seen after an oxide polish of a wafer. The dished topography is often referred to as a center-fast polishing state because the center of the wafer polishes at a faster rate than the edge of the wafer. The domed topography is designated center-slow because the center of the wafer polishes at a slower rate than the edge of the wafer. For obvious reasons, the dished topography may also be referred to as edge-slow, and the domed topography may also be referred to as edge-fast.

Commonly, each carrier head in a CMP tool has unique characteristics that cause the wafers it processes to have similar topographies. For example, a particular carrier head is more likely to produce all dished or domed wafers. Due to the multiplicity of carrier heads in a CMP tool, polished wafers in a given lot will have different post-polish topographies. Subsequent processes performed on the wafers, such as photolithography and etch processes, are affected by variations in the thickness of the polished layer on the wafer. The operating parameters of the subsequent processes are selected such that the process will work for either a domed or a dished topography. Such a compromise approach increases the variation in the processed wafers, because the acceptance ranges must be widened to account for the different input topologies. Generally, increased process variation results in lower profitability.

The present invention is directed to overcoming, or at least reducing the effects of, one or more of the problems set forth above.

SUMMARY OF THE INVENTION

One aspect of the present invention is seen in method for controlling wafer uniformity in a polishing tool. The method includes providing a plurality of carrier heads, determining a signature for each of the carrier heads, and installing carrier heads with similar signatures in a polishing tool.

Another aspect of the present invention is seen in a processing line including a polishing tool and a processing tool. The polishing tool is adapted to polish wafers. The polishing tool includes a plurality of carrier heads, each carrier head having a polishing signature similar to the other carrier heads. The processing tool is adapted to process the polished wafers in accordance with a recipe. At least one parameter in the recipe is based on the polishing signatures of the carrier heads.

BRIEF DESCRIPTION OF THE DRAWINGS

The invention may be understood by reference to the following description taken in conjunction with the accompanying drawings, in which like reference numerals identify like elements, and in which.

Figure 1:
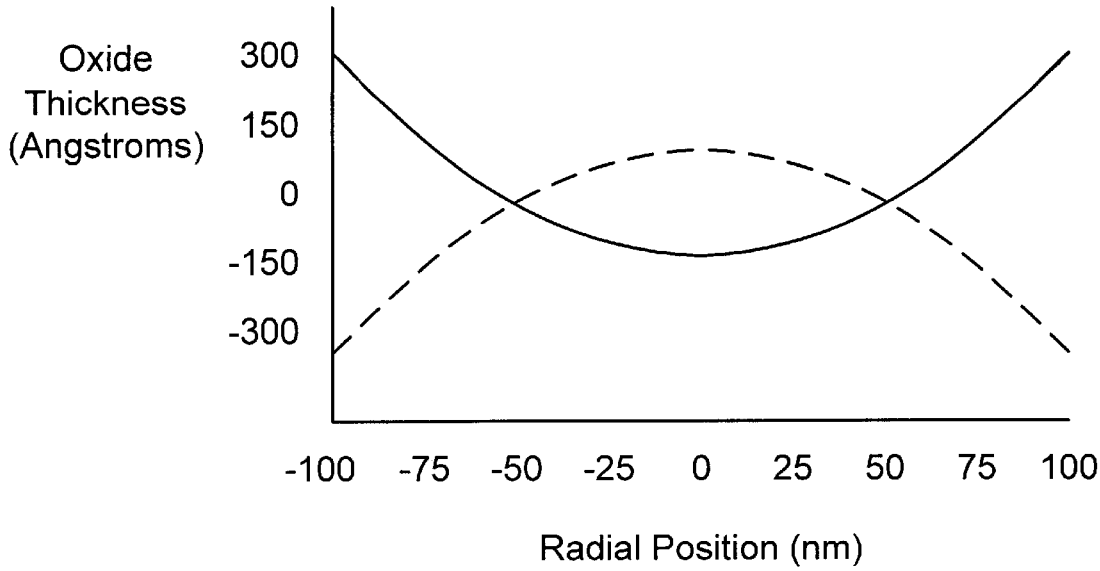
Figure 1 (Prior Art)
FIG. 1 is a graph illustrating surface non-uniformity of a wafer.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
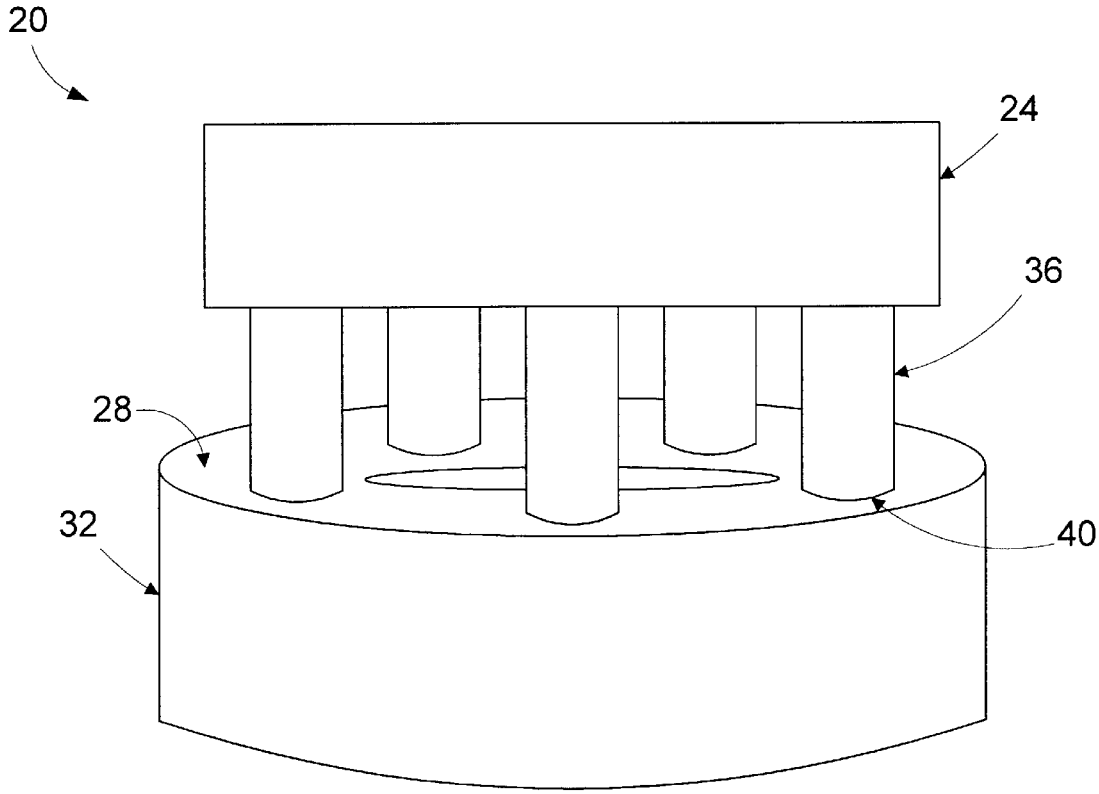
FIG. 2 illustrates a conventional polishing tool having multiple arms.

Referring to FIG. 2, a simplified illustration of an exemplary multiple arm polishing tool 20 is shown. The drawing of the polishing tool 20 in FIG. 2 is provided for illustrative purposes only and is not intended to represent a physical drawing of an actual tool. The polishing tool 20 includes a multi-head carrier 24 positioned above a polishing pad 28 that is mounted on a platen 32. The multi-head carrier 24 typically includes a plurality of rotatable polishing arms 36, each of which includes a carrier head 40. Wafers (not shown)

may be secured to the carrier heads 40 using known techniques, such as vacuum pressure. A source of polishing fluid (not shown) may be provided to supply polishing fluid (e.g., slurry) to the polishing pad 28. Furthermore, although five polishing arms 36 are shown, it is contemplated that the polishing tool 20 may include any number of polishing arms 36. To effectuate polishing, the platen 32 may be rotated at a typically constant table speed. Individually variable downward forces may be applied to each of the polishing arms 36, and the polishing arms 36 may be rotated and oscillated back and forth across the polishing pad 28.

Figure 3:
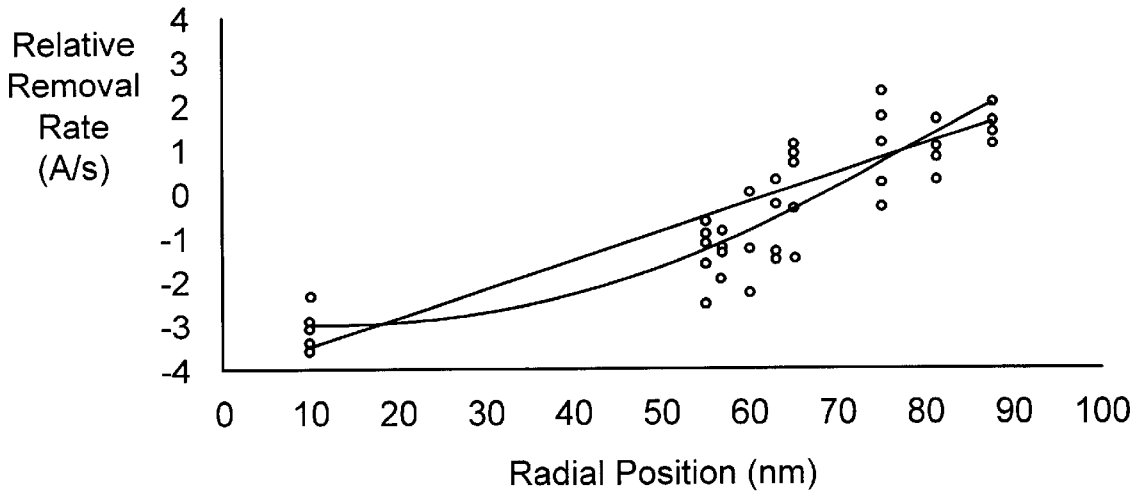
FIG. 3 is a graph illustrating a center-to-edge polish rate profile.

Referring to FIG. 3, a center-to-edge radial polish rate profile for a sample of five wafers processed using one of the carrier heads 40 is shown. The pre-polish and post-polish thickness of the polished layer may be measured at a plurality of radial positions along the wafer. Once measured, the polish rate at these radial positions may be determined by comparing the post-polish and pre-polish measurements and both quadratic and linear polynomials may be fit to the polish rate profile. In one embodiment, the tendency of the carrier head 40 (e.g., center-fast, center-slow, etc.) may be characterized by the slope of the linear curve fit (i.e., polish rate slope.) For example, a positive slope of the radial polish rate profile indicates center-slow polishing while a negative slope indicates center-fast polishing. The polish rate profile associated with each particular carrier head 40 may be referred to as its polishing signature. Somewhat like a fingerprint, it is often possible to distinguish between carrier heads 40 based on their polishing signatures.

To increase the consistency at which the polishing tool 20 polishes wafers, the signatures of a plurality of the carrier heads 40 are determined using a series of test wafers, and carrier heads 40 having similar signatures are installed in the polishing tool 20. A plurality of test wafers may be processed using a large number of carrier heads (e.g., 40). The carrier heads 40 are grouped by their signatures. For example, a group may be determined by the slope of the polish rate profile linear curve. Carrier heads 40 with associated slopes within a predetermined percentage range of each other (e.g., 3%) may be grouped together. The polishing tool 20 may be equipped with all center-slow or center-fast carrier heads 40 to reduce the variation seen in wafers polished by the polishing tool 20. Carrier heads 40 with more pronounced polishing profiles may be discarded in favor of carrier heads 40 with less steep profiles.

There are factors other than inherent characteristics of the carrier heads 40 that affect the polish profile of wafers polished by the polishing tool 20. For example, chemical and mechanical changes to the polishing pad during polishing and degradation of process consumables may cause a shift in the chemical mechanical polishing process. Reducing the variation caused by the carrier heads 40 reduces the overall polishing variation.

Due to the more uniform nature of the wafers polished in the polishing tool 20 equipped with carrier heads 40 having similar signatures, subsequent processing, such as etching or photolithography may be performed with greater accuracy. For example, if it is known that the wafers exiting the polishing tool 20 are more likely to have a center-slow topology, a subsequent etch process may be adjusted to etch the devices on the periphery of the wafer slower than the devices near the center. Experimental data captured in a mathematical model shows that reducing plasma power in an etch process increases the rate of etch in the center relative to that at the edge. The specific relationship between power and etch rate is dependent on factors such as the particular etch tool and the recipe being used. The relationship for a particular configuration may be determined empirically and a mathematical model may be derived.

Figure 4:
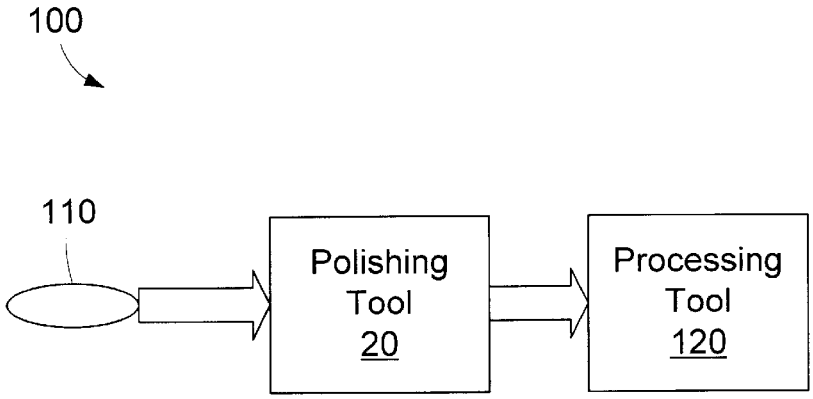
FIG. 4 is a simplified diagram of an illustrative processing line for processing wafers in accordance with one embodiment of the present invention.

FIG. 4 shows a simplified diagram of an illustrative processing line 100 for processing wafers 110 in accordance with one embodiment of the present invention. The processing line 100 includes the polishing tool 20 and a processing tool 120. In the illustrated embodiment, the processing tool 120 is an etch tool adapted to operate in accordance with an operating recipe. The signatures of the carrier heads 40 are used to determine an expected profile for the wafers 110 exiting the polishing tool 20. The operating recipe of the processing tool 120 is determined based, at least in part, on the expected profile of the wafers 110. As described above, if the processing tool 120 is a plasma etch tool, the plasma power may be set increased or decreased from a compromise value (i.e., one typically used when both center-fast and center-slow wafers 110 may be expected) based on the expected profile. Although the configuration of the recipe for the processing tool 120 is described as it may be implemented with a plasma etch tool, the invention is not so limited, and a variety of tools may be used.

Figure 5:
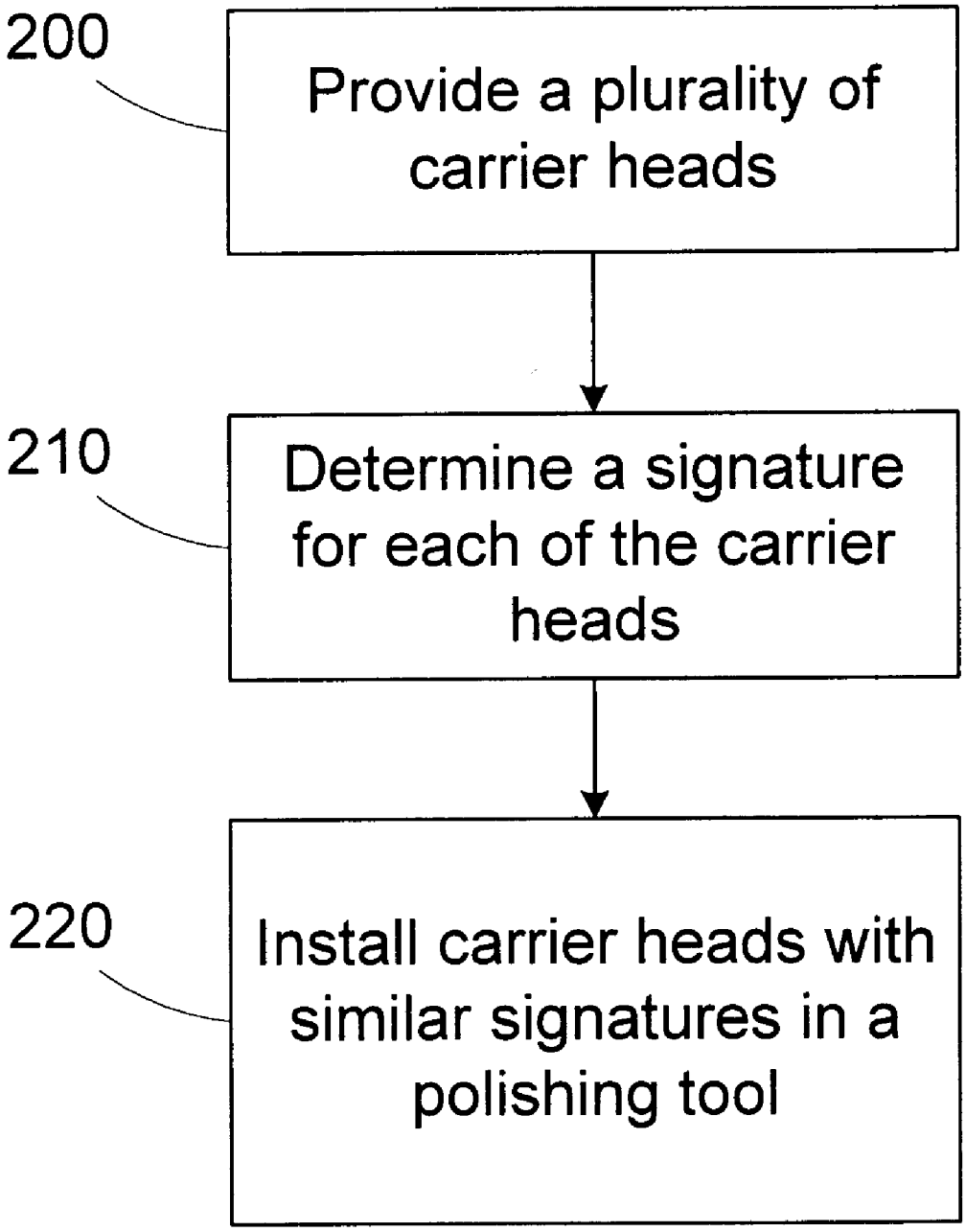
FIG. 5 is a flow chart illustrating an exemplary method for controlling wafer uniformity in a chemical mechanical polishing tool using carrier head signatures in accordance with one embodiment of the present invention.

Turning now to FIG. 5, a flow diagram of a method for controlling wafer uniformity in a chemical mechanical polishing tool is provided. In block 200, a plurality of carrier heads are provided. In block 210, a signature for each of the carrier heads is determined. In block 220, carrier heads with similar signatures are installed in a polishing tool.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for controlling wafer uniformity in a polishing tool, comprising:

providing a plurality of carrier heads;

determining a polishing signature for each of the carrier heads, the polishing signature relating to a tendency of the carrier head to polish along a continuum between a center-fast profile and a center-slow profile; and installing carrier heads from the plurality of carrier heads with similar polishing signatures along the continuum in a polishing tool.

2. The method of claim 1, further comprising:

polishing wafers with the polishing tool; and determining an expected wafer profile for the polished wafers based on the determined signatures of the installed carrier heads.

3. A method for controlling wafer uniformity in a polishing tool, comprising:

providing a plurality of carrier heads;

determining a signature for each of the carrier heads;

installing carrier heads from the plurality of carrier heads with similar signatures in a polishing tool;

polishing wafers with the polishing tool;

determining an expected wafer profile for the polished wafers based on the determined signatures of the installed carrier heads; and processing the polished wafers in a processing tool in accordance with a recipe, the recipe being based on the expected wafer profile.

4. The method of claim 3, wherein processing the polished wafers in the processing tool comprises processing the polished wafers in a plasma etch tool, and the recipe includes a plasma power parameter, the plasma power parameter being based on the expected wafer profile.

5. A method for controlling wafer uniformity in a polishing tool, comprising:

providing a plurality of carrier heads;

determining a signature for each of the carrier heads by:

polishing a plurality of test wafers using a selected one of the carrier heads;

measuring the thickness of the polished test wafers at various points along the radius of each of the polished test wafers;

generating the signature for the selected carrier head based on the thickness measurements; and repeating the polishing, measuring, and generating for each of the carrier heads; and installing carrier heads from the plurality of carrier heads with similar signatures in a polishing tool.

6. A method for controlling wafer uniformity in a polishing tool, comprising:

providing a plurality of carrier heads;

determining a signature for each of the carrier heads by determining a slope of a polishing profile for the carrier head; and installing carrier heads from the plurality of carrier heads with similar signatures in a polishing tool.

7. The method of claim 6, wherein installing carrier heads with similar signatures in the polishing tool includes selecting carrier heads having slopes within a predetermined percentage range of each other.

8. A method for controlling wafer uniformity in a polishing tool, comprising:

providing a plurality of carrier heads;

determining a signature for each of the carrier heads; and installing carrier heads from the plurality of carrier heads with similar signatures in a polishing tool, the similar signatures being center-fast signatures.

9. A method for controlling wafer uniformity in a polishing tool, comprising:

providing a plurality of carrier heads;

determining a signature for each of the carrier heads; and installing carrier heads from the plurality of carrier heads with similar signatures in a polishing tool, the similar signatures being center-slow signatures.

10. A method for controlling wafer uniformity in a polishing tool, comprising:

providing a plurality of carrier heads;

determining a signature for each of the carrier heads;

installing carrier heads with similar signatures in a polishing tool;

polishing wafers with the polishing tool;

determining an expected wafer profile for the polished wafers based on the signatures; and configuring an operating recipe of a processing tool based on the expected wafer profile; and processing the polished wafers in the processing tool.

11. The method of claim 10, wherein processing the polished wafers in the processing tool comprises processing the polished wafers in a plasma etch tool, and the operating recipe includes a plasma power parameter, the plasma power parameter being based on the expected wafer profile.

12. The method of claim 10, wherein determining the signature for each of the carrier heads comprises:

polishing a plurality of test wafers using a selected one of the carrier heads;

measuring the thickness of the polished test wafers at various points along the radius of each of the polished test wafers;

generating the signature for the selected carrier head based on the thickness measurements; and repeating the polishing, measuring, and generating for each of the carrier heads.

13. The method of claim 10, wherein determining the signature of a particular carrier head includes determining a slope of a polishing profile for the carrier head.

14. The method of claim 13, wherein installing carrier heads with similar signatures in the polishing tool includes selecting carrier heads having slopes within a predetermined percentage range of each other.

15. The method of claim 10, wherein installing carrier heads with similar signatures in the polishing tool includes installing carrier heads having center-fast signatures in the polishing tool.

16. The method of claim 10, wherein installing carrier heads with similar signatures in the polishing tool includes installing carrier heads having center-slow signatures in the polishing tool.

17. A processing line, comprising:

a polishing tool adapted to polish wafers, the polishing tool including a plurality of carrier heads, each carrier head having a polishing signature similar to the other carrier heads; and a processing tool adapted to process the polished wafers in accordance with a recipe, the recipe including at least one parameter based on the polishing signatures of the carrier heads.

18. The processing line of claim 17, wherein the processing tool comprises a plasma etch tool, and the recipe includes a plasma power parameter, the plasma power parameter being based on the polishing signatures.

19. The processing line of claim 17, wherein the polishing signature of a particular carrier head comprises a slope of a polishing profile for the particular carrier head.

20. The processing line of claim 19, wherein the carrier heads have associated slopes within a predetermined percentage range of each other.

21. The processing line of claim 17, wherein the carrier heads have center-fast signatures.

22. The processing line of claim 17, wherein the carrier heads have center-slow signatures.

* * * * *